US005655026A

United States Patent [19]

Peters et al.

[11] Patent Number: 5,655,026

[45] Date of Patent: Aug. 5, 1997

[54] EAR RECEIVER

[75] Inventors: Jean M. Peters, Carpentersville; Bruce L. Graham, Schaumburg; Eric O. Staehle, Fox River Grove; Terrence M. Budzynski, Carpentersville; Robert G. Dinello, Genoa, all of Ill.

[73] Assignee: Otto Engineering, Inc., Carpentersville, Ill.

[21] Appl. No.: 173,418

[22] Filed: Dec. 23, 1993

[51] Int. Cl.[6] ..... H04R 25/00

[52] U.S. Cl. ..... 381/187; 381/183

[58] Field of Search ..... 381/183, 187, 381/25, 188, 205, 68.7; 379/430; 29/594

[56] References Cited

U.S. PATENT DOCUMENTS

| | | | |
|---|---|---|---|
| D. 237,090 | 10/1975 | Yanagawa | D14/3 |
| D. 272,904 | 3/1984 | Kawano | D14/3 |
| D. 326,653 | 6/1992 | Hono | 14/192 |
| D. 326,654 | 6/1992 | Brown | 14/192 |
| 1,581,882 | 4/1926 | Stace . | |
| 1,587,643 | 6/1926 | Harman . | |
| 2,474,135 | 6/1949 | White | 179/182 |
| 3,862,378 | 1/1975 | Norris | 179/156 A |
| 3,906,478 | 9/1975 | Smey | 340/279 |
| 4,453,050 | 6/1984 | Enokido | 179/182 |
| 4,677,675 | 6/1987 | Killion et al. | 381/68.2 |
| 4,785,816 | 11/1988 | Dow et al. | 128/660.1 |
| 4,875,233 | 10/1989 | Derhaag et al. | 381/183 |
| 4,893,344 | 1/1990 | Tragardh et al. | 381/187 |
| 5,450,496 | 9/1995 | Burris et al. | 381/183 |

FOREIGN PATENT DOCUMENTS

| | | |
|---|---|---|
| 244384 | 9/1924 | United Kingdom . |
| 270187 | 12/1926 | United Kingdom . |
| 2 096 861 | 10/1982 | United Kingdom . |

OTHER PUBLICATIONS

Sony MDR–E5 Earphone: Photographs 1–8.

Motorola Test Earphone: Photographs 1–8.

*Primary Examiner*—Sinh Tran

*Attorney, Agent, or Firm*—McAndrews, Held & Malloy, Ltd.

[57] ABSTRACT

An ear receiver positions a transducer in close proximity to the human ear. A housing carries a transducer and has an exterior opening through which audible sound from the transducer radiates. A support arm member has a first end connected to the housing and a second end extending from the housing in a direction substantially parallel to the housing exterior opening. An ear piece is formed to fit around the pinna of a human ear. The ear piece has one end movably connected to the second end of the support arm for rotation about at least two axes. Preferably the ear piece rotates about a first axis which is perpendicular to the support arm and a second axis which is perpendicular to the first axis. A signal delivery mechanism, such as an electrical conductor, is provided for delivering an input signal to the transducer.

17 Claims, 4 Drawing Sheets

EAR RECEIVER

FIELD OF THE INVENTION

The present invention relates generally to an ear receiver and, more particularly, to an ear receiver which houses a transducer and is carried on the pinna of the human ear.

BACKGROUND OF THE INVENTION

Ear receivers are commonly used by individuals including pilots, receptionists, secretaries, whose jobs require them be able to receive audio messages while having their hands free to perform other tasks. In the past a variety of designs including headsets, ear plugs, and supports for attachment to the pinna and other portions of the body, have been developed for positioning a miniaturized loudspeaker in close proximity to the concha of the human ear. However, known designs suffer from drawbacks including excessive weight; general discomfort; irritation of the skin; restriction of movement; lack of adjustability; and inconvenience in their application and removal.

The present invention is directed to overcoming one or more of the above-noted problems.

More specifically, an object of the present invention is to provide a lightweight ear receiver which is carried on the pinna of the human ear.

A further object of the present invention is to provide an ear receiver which can be adjusted to fit on either a person's left or right ear.

Still another object of the present invention to provide ear receiver which permits the position of the transducer to be adjusted for optimal sound delivery to the ear.

Another object of the present invention is to provide an ear receiver having an ear piece which rotates about more than one axes.

It is yet another object of the present invention to provide an ear receiver which is simple and economical to manufacture.

Other objects and advantages of the invention will become apparent upon reading the following detailed description and appended claims, and upon reference to the accompanying drawings.

SUMMARY OF THE INVENTION

In accordance with one aspect of the present invention an apparatus is provided for positioning a transducer in close proximity to the human ear. The transducer is of the type which produces audible sound in response to an input signal. The apparatus comprises a housing for carrying the transducer; a support arm connected to the housing; an ear piece formed to fit around the pinna of a human ear; and a signal delivery means for delivering the input signal to the transducer. The ear piece has one end movably connected to the support to permit rotation of the earpiece about at least two axes.

In one embodiment an L-shaped member connects the support arm to the ear piece. The L-shaped member has a first end frictionally and rotatably connected to the support arm for rotation about a first axis which is perpendicular to the support arm and a second end frictionally and rotatably connected to one end of the ear piece to permit rotation of the ear piece about a second axis which is perpendicular to the first axis.

In a second embodiment the ear piece and the support arm are connected by a ball and socket joint.

BRIEF DESCRIPTION OF THE DRAWINGS

For a more complete understanding of this invention reference should now be had to the embodiment illustrated in greater detail in the accompanying drawings and described below by way of example of the invention.

In the drawings.

DETAILED DESCRIPTION OF THE PREFERRED EMBODIMENTS

Figure 1:
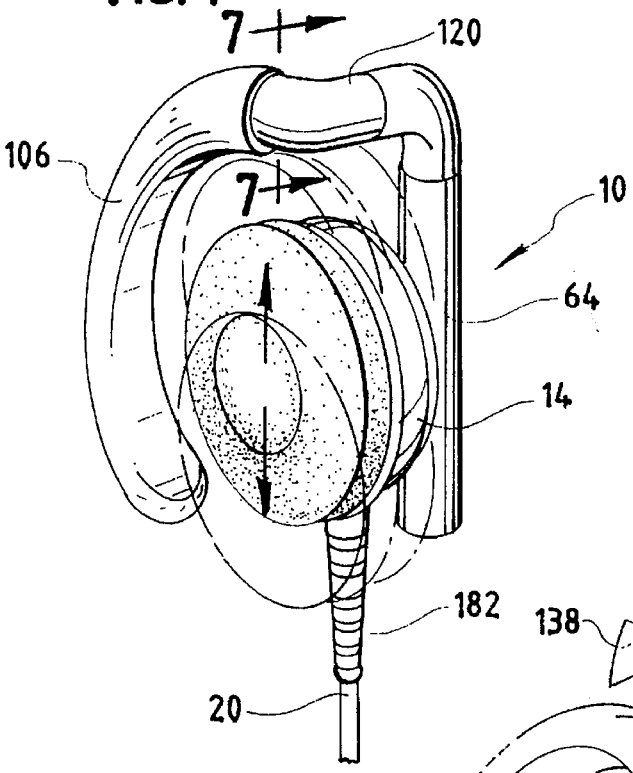
FIG. 1 is perspective view of an ear receiver according to the present invention illustrating in phantom lines the adjustability of the transducer.

In the following detailed description, spatially orienting terms are used such as "left," "right," "vertical," "horizontal," and the like. It is to be understood that these terms are used for convenience of description of the preferred embodiments by reference to the drawings. These terms do not necessarily describe the absolute location in space, such as left, right, upward, downward, etc., that any part must assume.

Referring now to the drawings a miniaturized ear receiver 10 is described in detail. The ear receiver 10 is adapted to be carried on the pinna of the human ear, i.e. the external ear, for positioning a sound producing transducer in close proximity to the concha of the human ear. As can best be seen in FIGS. 3-4, the ear receiver 10 includes a housing 14 accommodating a sound producing transducer 16 such as a miniaturized loud speaker. The transducer 16 is of the type which receives an electrical input signal and converts it to an audible sound. Transducers of this type are well known in the art and, hence, the transducer 16 is not explained in greater detail.

A signal delivery means 18 is provided for delivering the input signal to the transducer 16. The signal delivery means 18 includes a power cord 20 which extends from the housing 14 for connection to a remote device such as a radio or a telephone. The power cord 20 houses a pair of electrical conductors **24*a*, 24*b*. Each electrical conductor 24 has a first end connected to the transducer 16 (see FIG. 4) and a second end connected to a connection device 28 such as an electrical jack. (See FIG. 2). It should be understood that the ear receiver 10 can also be used in conjunction with transducers which receive other forms of input signals, such a radio signals, thereby eliminating the need for the power cord 20**.

The housing 14 has a dish-shaped back wall 32 and an annular side wall 36 extending from the back wall 34. The housing 14 is made of a rigid material such as injection molded nylon, ABS plastic, or polyvinyl chloride (PVC). The back wall 34 and side wall define an inner compartment 38 which terminates in a generally planar front opening 40. During assembly, the transducer 16 is slid through the front opening 40 and positioned in the inner compartment 38 such that sound producing face 44 of the transducer 16 is substantially parallel to the plane 68 of the front opening 40. Hence, a majority of the sound produced by the transducer 16 radiates through the housing front opening 40.

Figure 3:
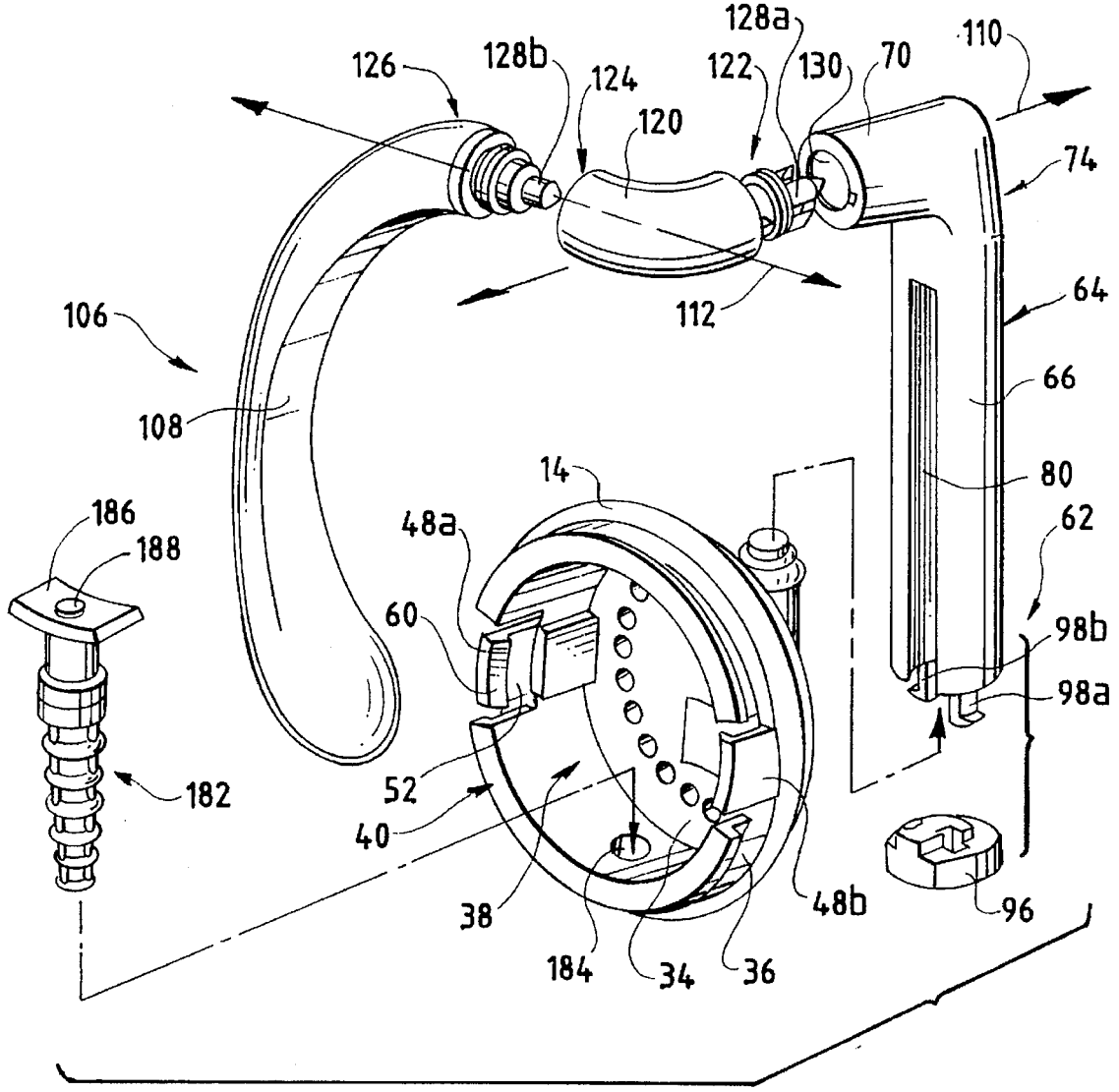
FIG. 3 is a partial exploded perspective view of the ear receiver of FIG. 1.
Figure 6:
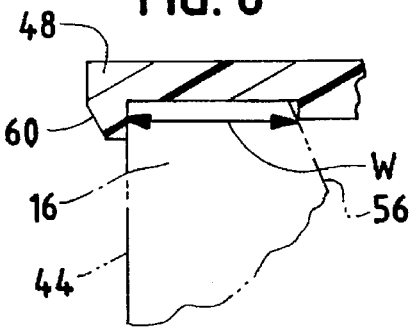
FIG. 6 is a cross-sectional view of an intersection between the housing and the transducer along line 6—6 of FIG. 4.

As can best be seen in FIGS. 3 and 6 a pair of resilient locking tabs 48*a*, 48*b* are formed in opposite sides of the housing side wall 36 to releasably lock the transducer 16 into the housing inner compartment 38. Each locking tab 48 includes a retention groove 52 of a width W which is substantially the same as the thickness of the transducer 16. During assembly the transducer 16 is pushed into the housing 14 and the inner edges 56 of the transducer 16 bias the locking tabs 48 outwardly to allow the transducer 16 to move past the ends 60 of the locking tabs 48. The ends 60 of the locking tabs 48 are beveled to allow the transducer 16 to be easily snapped into place in the housing 14. Once the sound producing face 44, i.e. the outer edge, of the transducer 16 moves past the ends 60 of the locking tabs 48, the tabs 48 snap back into place and lock the transducer 16 into the retention grooves 52.

Figure 4:
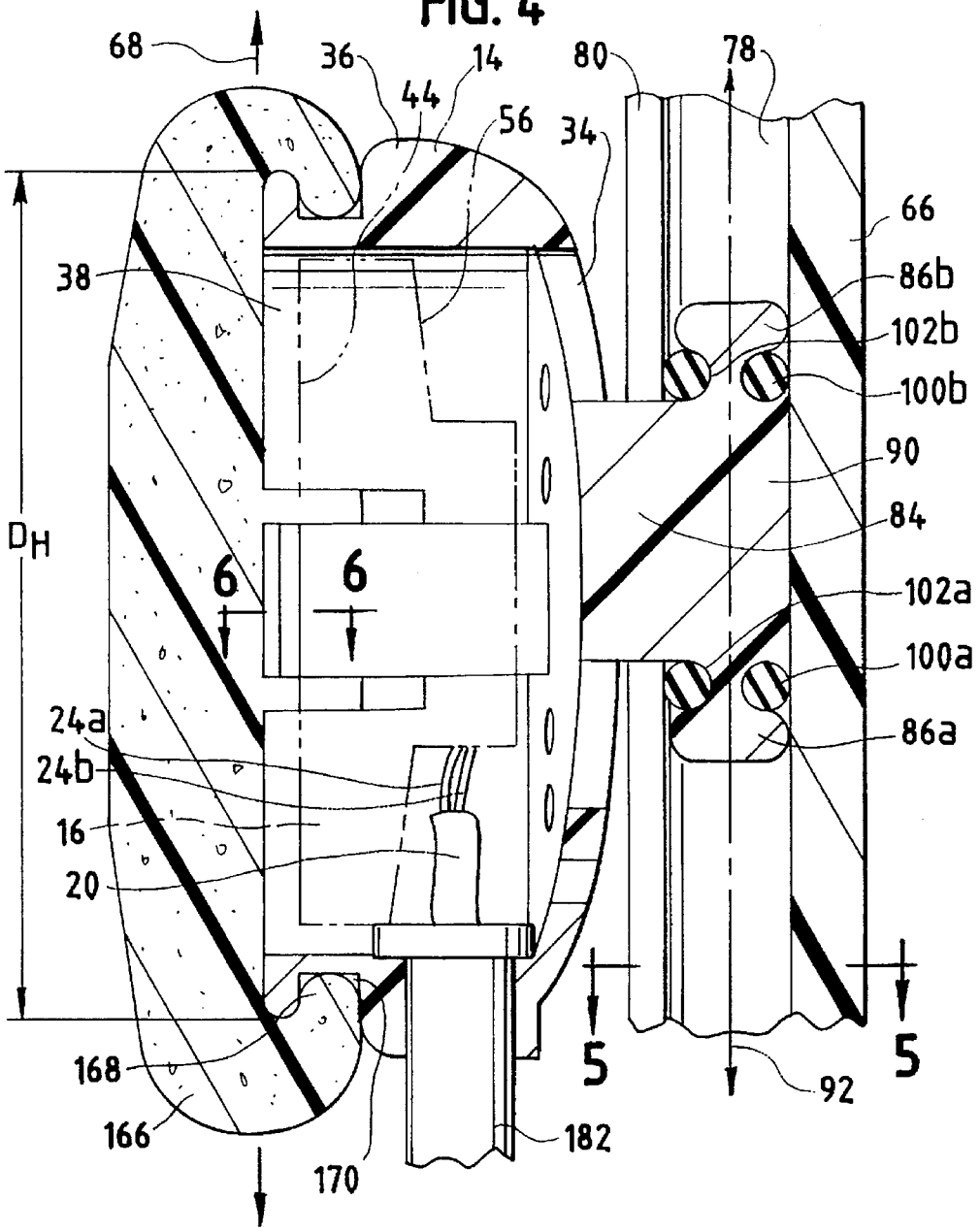
FIG. 4 is a partial cross-sectional view of the ear receiver of FIG. 1.
Figure 5:
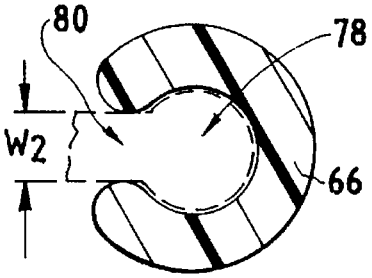
FIG. 5 is a cross-sectional view of the support arm along line 5—5 of FIG. 4.

Referring to FIGS. 3–5, a support arm 62 extends upwardly from the back wall 34 of the housing 14. The support arm 64 is formed of a rigid material such as injection molded nylon, ABS plastic or PVC. The support arm 64 includes a first portion 66 which is substantially linear and extends in a direction substantially parallel to the plane 68 of the housing front opening 40. The support arm 64 also includes a second portion 70 which extends perpendicularly from the top end 74 of the support arm first portion 66 and in the same direction as the housing front opening 40.

Preferably the housing 14 is slidably connected to the support arm first portion 66 to permit the housing 14 to be adjusted along at part of the first portion 66, as is shown in FIG. 1. For this purpose the support arm first portion 66 includes a longitudinal inner bore 78 and an outer slot 80 extending along at least part of the first portion 66. A connecting bracket 84 extends from the housing back wall 34 and slidably engages the support arm first portion 66. The connecting bracket 84 is generally rectangular and has a thickness approximately equal to the width $W_2$ of the longitudinal groove 80. (See FIG. 5). Rounded portions 86*a*, 86*b* are formed at the top and bottom of the distal end 90 of the connecting bracket 84 along an axis 92 which is substantially parallel to the plane 68 of the housing front opening 40. The support arm 64 has a bottom cap 96 (see FIG. 3) which can be removed to allow the rounded portions 86 to be inserted into the longitudinal bore 78.

After the connection bracket 84 is inserted into the longitudinal bore 78 and slot 80, the cap 96 can be snapped onto the bottom 62 of the support arm 64 by a pair of locking tabs 98*a*, 98*b*. The longitudinal slot 80 and bore 78 allow the housing 14 to slide along the length of the support arm first portion 66 while limiting rotation of the housing 14 with respect to the support arm 64. O-rings 100*a*, 100*b* are carried by reduced diameter retention grooves 102*a*, 102*b* formed in the rounded portions 86*a*, 86*b*. The o-rings 100 frictionally engage the sidewalls of the longitudinal bore 78 to maintain the position of the housing 14 once it has been adjusted along the length of the support arm first portion 66.

Figure 7:
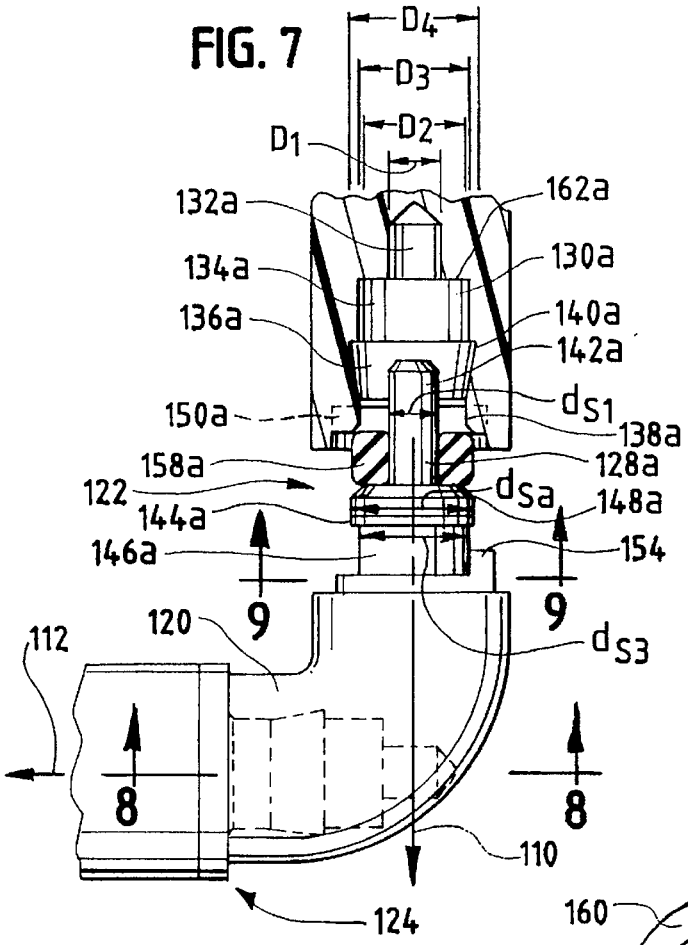
FIG. 7 is a cross-sectional view along line 7—7 of FIG. 1.
Figure 8:
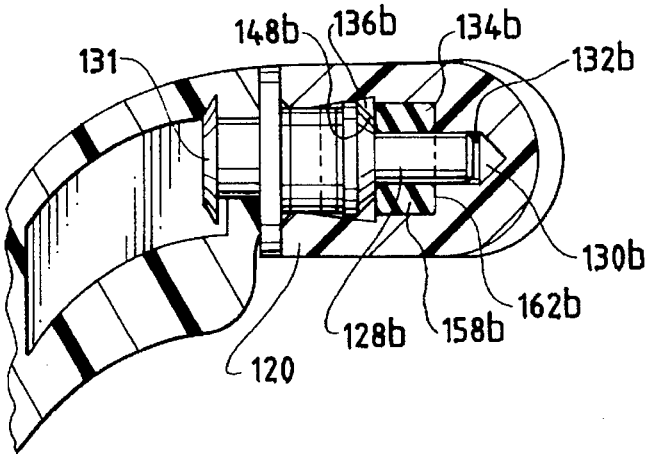
FIG. 8 is a cross-sectional view along of line 8—8 of FIG. 7.

As can best be seen in FIGS. 3, 7, and 8, an ear piece 106 in the form of a curved member 108 is movably connected to the top end 74 of the support arm 64 for rotation about at least two axes. Preferably the ear piece 106 is connected for rotation about a first axis 110 which is perpendicular to the support arm first portion 66 and a second axis 112 which is perpendicular to the first axis 110. The ear piece 106 is curved to fit around the pinna of a human ear and is made of a pliable material, such as a injection moldable thermoplastic rubber, so as to partially compensate for variations in the sizes and shapes of people's ears. A suitable material for forming the ear piece 106 is sold under the trade name SANTOPRENE® by Monsanto Chemicals.

The ear piece 106 is rotatably connected to the support arm 64 by an L-shaped member 120. The L-shaped member 120 has a first end 122 frictionally and rotatably connected to the top 74 of the support arm 64 for rotation about the first axis 110. A second end 124 of the L-shaped member 120 is frictionally and rotatably connected to the top end 125 of the ear piece 106 such that the ear piece 106 rotates about the second axis 112. For this purpose the first end 122 of the L-shaped member 120 terminates in a first stud 128*a* which snaps into a first reciprocal bore 130*a* formed in the end of support arm second portion 70. Similarly, the top end 126 of the ear piece 106 terminates in a second stud 128*b* which snaps into a second reciprocal bore 130*b* formed in the second end 124 of the L-shaped member 120. The L-shaped member 120 and the second stud 130*b* are formed from a rigid material such as injection molded nylon, ABS plastic or PVC. As can be seen in FIG. 8, the second stud 130*b* is formed separately from the ear piece 106 and is injection molded into the top 126 of the ear piece 106. A flange 131 formed in the proximate end of the second stud 130*b* prevents the stud 130*b* from being pulled out of the ear piece 106 during normal usage.

The first stud 128*a* is substantially perpendicular to the second reciprocal bore 130*b*, and the first reciprocal bore 128*a* is concentric to the first axis 110. Hence, when the ear receiver 10 is assembled, the ear piece 106 can be rotated about a first axis 110 which is perpendicular to the support arm first portion 66, i.e. parallel to the plane 68 of the housing front opening 40, and a second axis 112 which is perpendicular to the first axis 110. This movement allows the ear piece 106 to be adjusted both vertically and horizontally when the ear receiver 10 is on a person's ear. Moreover, this movement allows the ear piece 106 and L-shaped member 120 can be articulated between a first position at which the ear receiver 10 fits on an individual's right ear and a second position at which the ear receiver 10 fits on an individual's left ear. Articulation of the ear piece 106 can best be understood by referring to FIG. 2, where solid lines illustrate the ear piece 106 positioned for use on a person's right ear. To use the ear receiver 10 on the left ear, the ear piece 106 is initially rotated approximately 180° about the second axis 112. This movement is illustrated by the arrow 136. The ear piece 106 is then moved downwardly about the first axis 110 until it is in the proper position for use on the person's left ear. This movement is illustrated by the arrow 138.

Figure 9:
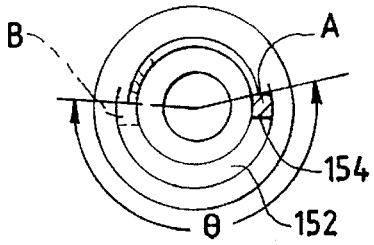
FIG. 9 is a cross-sectional view along line 9—9 of FIG. 7.

Referring to FIGS. 7–9, the interface between the studs 128*a,b* and the reciprocal bores 130*a,b* is explained in greater detail. The interface between the first stud 128*a* and the first reciprocal bore 130*a* is virtually identical to the interface between the second stud 128*a* and the second reciprocal bore 130*b*; hence, only one interface is explained in detail. Each reciprocal bore 130 includes an inner portion 132 having a first diameter $D_{B1}$, a middle portion 134 having a second diameter $D_{B2}$ which is greater than the first diameter $D_{B1}$, and an outer portion 136. The bore outer portion 136 is tapered between a third diameter $D_{B3}$ at its outer edge 138 and a fourth diameter $D_{B4}$ at its inner edge 140. The bore third diameter $D_{B3}$ is slightly larger than the bore second diameter $D_{B2}$, and the bore fourth diameter $D_{B4}$ is greater than the bore third diameter $D_{B3}$. Similarly, each stud 130 includes a first portion having a diameter $d_{s1}$ which slightly smaller than the bore first diameter $D_{B1}$, a second portion 144 having a diameter $d_{s2}$ which is slightly larger than the bore third diameter $D_{B3}$, and a third portion 146 having a diameter $d_{s3}$ which is slightly smaller than the bore third diameter $D_{B3}$. Because the diameter $d_{s2}$ of the stud second portion 144 is slightly larger than the bore second and third diameters $D_{B2}$, $D_{B3}$, the stud second portion 144 snaps into place between the outer and inner edges 138, 140 of the bore outer portion 136 as is shown in FIG. 8. The inner edge 148 of the stud second portion 144 is beveled to ease insertion of the stud 128 into the bore 130.

The stud first portion 142 is adapted to carry an o-ring 156 having an outer diameter which is slightly larger than the bore second diameter $D_{B2}$. When the stud 128 is snapped into the reciprocal bore 130, the o-ring 158 is compressed between the inner edge 148 of the stud second portion 144 and the inner surface 162 of the bore middle portion 134. (See FIG. 8) In this position, the o-ring frictionally engages the bore 130 and the stud 128. This frictional interface maintains the positions of the ear piece 106 and the L-shaped member 120 once they have been adjusted by the user.

A limiting mechanism can be provided for limiting rotation of the L-shaped bracket 120 about the first axis 110 to an angle of approximately 180°. The limiting mechanism includes an increased diameter groove 152 formed in the outer portion 136*a* of the first bore 130*a*. (See FIG. 9) A reciprocal stop tab 154 formed in the third portion 146*a* of the first stud 128*a* engages the groove 152 when the first stud 128*a* is inserted into the bore 130*a*. The groove 152 extends through an arc θ which exceeds 180° by the width of the tab 154. The combination of the groove 152 and the stop tab 154 limits travel of the L-shaped bracket 120 between a first position (position A in FIG. 9) and a second position (position B in FIG. 9).

Referring to FIG. 4, a perforated foam ear cushion 166 fits over the housing front opening 40 to provide a comfortable interface between the housing 14 and the user's ear. The ear cushion 166 is made from commercially available acoustic foam. The ear cushion 166 has a rear opening which is smaller than the outer diameter $D_H$ of the housing 14. The flexible ear cushion material can be stretched to fit over the end of the housing 14. Once the ear cushion 166 is in place, the edge 168 of the cushion opening fits in a retention groove 170 formed in the outer edge of the housing 14 to secure the cushion 166 to the housing 14.

Figure 2:
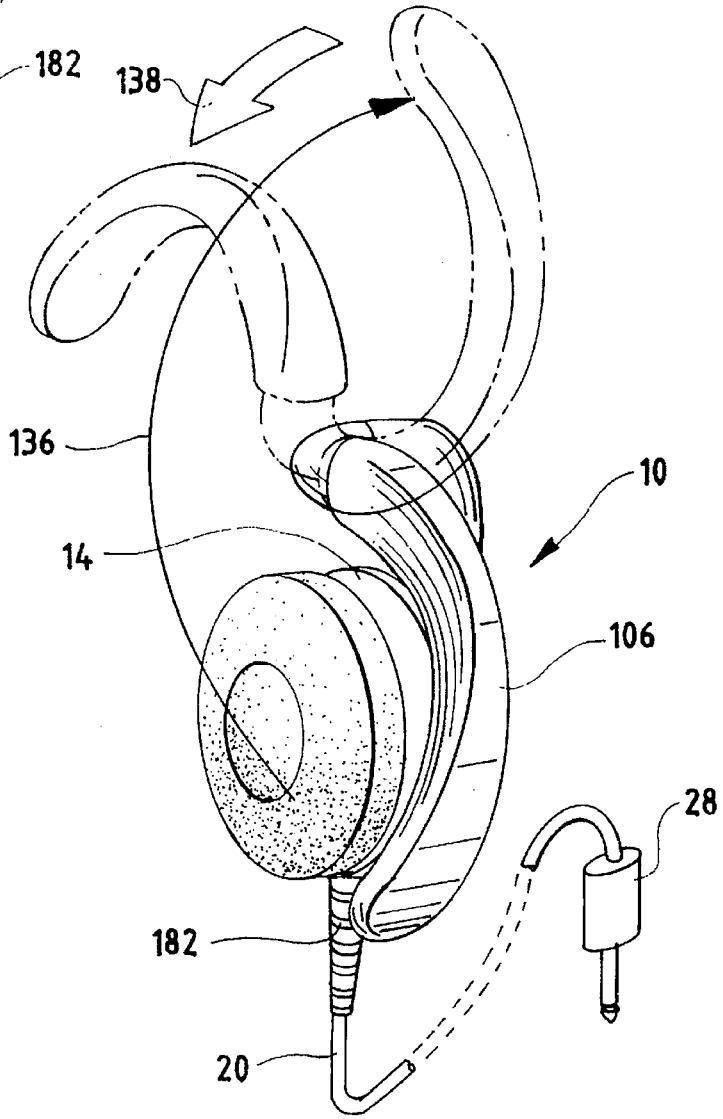
FIG. 2 is a perspective view of the ear receiver of FIG. 1 illustrating the adjustability of the ear piece.

Referring to FIGS. 1–3, a strain relief 182 is formed at the junction of the power cord 20 and the housing 14. The strain relief 182 is separately formed from a flexible material such as molded rubber and is adapted to snap into an aperture 184 in the bottom of the housing 14. A flange or extension 186 formed in the top of the strain relief 182 prevents the strain relief 182 from being pulled out of the housing 14 during normal usage. The strain relief 182 has a center bore 188 adapted to receive the power cord 20.

Figure 10:
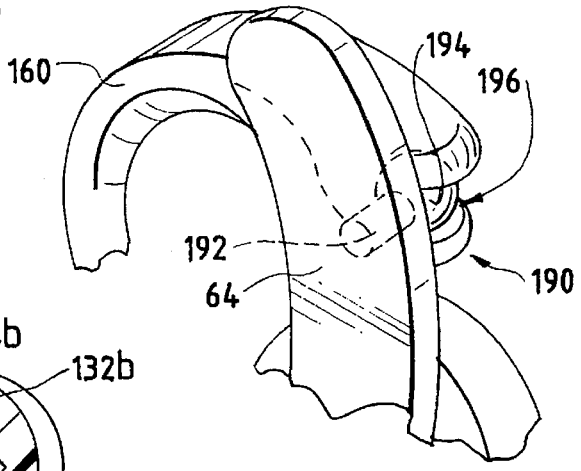
FIG. 10 is a perspective view of an alternative embodiment of an articulation joint for use in the present ear receiver.

A second embodiment for connecting the ear piece 106 to the support arm 64 is generally illustrated in FIG. 10. This alternative embodiment is in the form of a ball and socket joint 190. In particular, an integrally formed post 192 extends perpendicularly from the top end of the support arm 64 and terminates in a ball 194 or sphere. The ball 194 is adapted to snap into a reciprocal socket 196 formed in the top end of the ear piece 106. This ball and socket connection 190 is advantageous over the first embodiment in that it permits movement of the ear piece 106 about more than two axes. However, this type of connection is not generally as durable as the connection shown and described in the first embodiment.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An apparatus for positioning a transducer in close proximity to the human ear, the transducer being of the type which produces audible sound in response to an input signal, comprising:

a housing carrying the transducer and having an exterior front opening through which audible sound from the transducer radiates;

a support arm connected to the housing, the support arm being substantially linear and having a first end connected to the housing and a second end extending away from the housing in a direction substantially parallel to the housing front opening;

an ear piece formed to fit around the pinna of a human ear, the ear piece having a first end movably connected to the second end of the support arm for rotation over a range of at least 180° about each of two axes, a first axis, being substantially perpendicular to the housing front opening and a second axis being substantially parallel to the housing front opening; an L-shaped member connecting the support arm to the ear piece, the L-shaped member having a first end frictionally and rotatably connected to the second end of the support arm for rotation about the first axis and a second end frictionally and rotatably connected to the first end of the ear piece to permit rotation of the ear piece about the second axis; and signal delivery means for delivering the input signals to the transducer.

2. An apparatus as set forth in claim 1, wherein the signal delivery means comprises at least one electrical conductor having a first end electrically connected to the transducer and a second end extending from the housing for connection to a remote device.

3. An apparatus as set forth in claim 1, wherein the ear piece is pliable.

4. An apparatus as set forth in claim 1, wherein the housing is frictionally and slidably connected to the support arm for longitudinal movement along at least a portion of the support arm.

5. An apparatus as set forth in claim 1, wherein the L-shaped member snaps into the support arm.

6. An apparatus as set forth in claim 1, wherein the ear piece snaps into the L-shaped member.

7. An apparatus as set forth in claim 1, wherein the transducer snaps into the housing.

8. An apparatus for positioning a transducer in close proximity to the human ear, the transducer being of the type which produces audible sound in response to an input signal, comprising:

a housing carrying the transducer and having an exterior opening through which audible sound from the transducer radiates;

a support arm connected to the housing, the support arm being substantially linear and having a first end connected to the housing and a second end extending away from the housing in a direction substantially parallel to the housing exterior opening;

an ear piece formed to fit around the pinna of a human ear;

an L-shaped member connecting the support arm to the ear piece, the L-shaped member having a first end fictionally and rotatably connected to the second end of the support arm for rotation about a first axis which is substantially parallel to the support arm and a second end fictionally and rotatably connected to the ear piece to permit rotation of the ear piece about a second axis which is substantially perpendicular to the first axis;

limiting means for limiting rotation of the L-shaped member about the first axis to an angle less than 360°; and signal delivery means for delivering the input signals to the transducer.

9. An apparatus as set forth in claim 8, wherein the support arm includes first and second linear portions, the first linear portion having a proximate end connected to the housing and a distal end extending away from the housing in a direction substantially parallel to the exterior opening, the second linear portion extending perpendicularly from the distal end of the first linear portion.

10. An apparatus as set forth in claim 8, wherein the signal delivery means comprises at least one electrical conductor having a first end electrically connected to the transducer and a second end extending from the housing for connection to a remote device.

11. An apparatus as set forth in claim 8, wherein the ear piece is pliable.

12. An apparatus as set forth in claim 8, wherein the housing is frictionally and slidably connected to the support arm for longitudinal movement along at least a portion of the support arm.

13. An ear receiver of the type carried by the pinna of the human ear, comprising:

a housing having an exterior front opening;

a transducer adapted to receive an input signal and responsively produce audible sound, the transducer being mounted in the housing such that the audible sound produced by the transducer radiates through the housing exterior opening;

a support arm connected to the housing, the support arm being substantially linear and having a first end connected to the housing and a second end extending away from the housing in a direction substantially parallel to the housing exterior front opening;

an ear piece formed to fit around the pinna of a human ear, the ear piece having a first end movably connected to the second end of the support arm for rotation over a range of at least 180° about each of two axes, a first axis being substantially perpendicular to the housing front opening and a second axis being substantially parallel to the housing front opening;

an L-shaped member connecting the support arm to the ear piece, the L-shaped member having a first end frictionally and rotatably connected to the second end of the support arm for rotation about the first axis and a second end frictionally and rotatably connected to the first end of the ear piece for rotation about the second axis; and signal delivery means for delivering the input signals to the transducer.

14. An ear receiver as set forth in claim 13, wherein the transducer snaps into the housing.

15. An ear receiver as set forth in claim 13, further comprising limiting means for limiting rotation of the L-shaped member about the first axis to an angle less than 360°.

16. An ear receiver as set forth in claim 13, wherein the support arm includes first and second linear portions, the first linear portion having a proximate end connected to the housing and a distal end extending away from the housing in a direction substantially parallel to the housing front exterior opening, the second linear portion extending perpendicularly from the distal end of the first linear portion.

17. An ear receiver of the type carried by the pinna of the human ear, comprising:

a housing having generally dish-shaped back wall and a connecting bracket extending from the housing back wall, the housing defining an interior compartment terminating in a generally planar front opening opposite the back wall;

a transducer adapted to receive an input signal and responsively produce audible sound, the transducer being mounted in the housing interior compartment such that the audible sound produced by the transducer radiates from the housing front opening;

a substantially linear support arm connected to the housing, the support arm having a first end slidably connected to the housing back wall at a location substantially opposite the housing front opening and a second end extending away from the housing in a direction substantially parallel to the housing from opening, the support arm including a longitudinal inner bore opening to an outer slot, the connecting bracket slidably engaging in the outer slot and bore to permit longitudinal sliding movement of the housing relative along at least a portion of the support arm;

an ear piece formed to fit around the pinna of a human ear, the ear piece having a first end movably connected to the second end of the support arm for rotation over a range of at least 180° about first axis which is substantially perpendicular to the housing front opening and over a range of at least 180° about a second axis which is substantially parallel to the housing front opening; and at least one electrical conductor extending from the bottom of the housing and being adapted to deliver input signals to the transducer.

* * * * *